US008511507B1

(12) United States Patent
Malik

(10) Patent No.: US 8,511,507 B1
(45) Date of Patent: Aug. 20, 2013

(54) DECORATIVE COVER OBJECT FOR A CAN

(76) Inventor: Neil Kumar Malik, Riverside, RI (US)

( * ) Notice: Subject to any disclaimer, the term of this patent is extended or adjusted under 35 U.S.C. 154(b) by 0 days.

(21) Appl. No.: 13/210,536

(22) Filed: Aug. 16, 2011

(51) Int. Cl.
*A47G 19/22* (2006.01)
*B65D 5/74* (2006.01)

(52) U.S. Cl.
USPC ..... 220/711; 220/703; 222/570

(58) Field of Classification Search
USPC ..... 220/717, 703, 705, 711, 716, 254.8, 220/253, 254.1, 287, 713; 222/566–570, 222/574; 215/204, 217, 387, 388
See application file for complete search history.

(56) References Cited

U.S. PATENT DOCUMENTS

| | | | | |
|---|---|---|---|---|
| 4,852,776 | A | 8/1989 | Patton | |
| 4,883,192 | A * | 11/1989 | Krugman | 220/711 |
| 4,917,258 | A * | 4/1990 | Boyd et al. | 220/240 |
| 4,938,379 | A * | 7/1990 | Kellner | 220/370 |
| 4,961,510 | A * | 10/1990 | Dvoracek | 220/713 |
| 5,065,909 | A * | 11/1991 | Pino et al. | 222/484 |
| 5,071,042 | A * | 12/1991 | Esposito | 222/570 |
| 5,104,013 | A * | 4/1992 | Hawley | 222/566 |
| 5,176,278 | A * | 1/1993 | Quarberg | 220/320 |
| 5,242,079 | A * | 9/1993 | Stephens et al. | 220/705 |
| 5,337,918 | A * | 8/1994 | Wang | 220/708 |
| 5,467,888 | A * | 11/1995 | Brandstrom et al. | 220/319 |
| 5,842,592 | A * | 12/1998 | Beck | 215/253 |
| 5,878,898 | A * | 3/1999 | Shefflin | 215/11.6 |
| 5,947,324 | A * | 9/1999 | Palinchak | 220/713 |
| D474,938 | S | 5/2003 | Malik | |
| 6,708,833 | B2 * | 3/2004 | Kolb | 215/11.1 |
| D507,181 | S | 7/2005 | Malik | |
| D513,988 | S | 1/2006 | Malik | |
| D567,659 | S | 4/2008 | Gran et al. | |
| 7,556,172 | B2 * | 7/2009 | Lane | 220/714 |
| 7,810,662 | B2 * | 10/2010 | DeLong | 215/11.4 |
| 7,832,589 | B2 * | 11/2010 | Dunwoody et al. | 220/711 |
| 2001/0022304 | A1 * | 9/2001 | Roche | 220/212 |
| 2004/0000551 | A1 * | 1/2004 | Flink et al. | 220/258.3 |
| 2006/0163190 | A1 * | 7/2006 | Laveault et al. | 215/257 |
| 2008/0078200 | A1 * | 4/2008 | Roth et al. | 62/457.4 |
| 2010/0018975 | A1 * | 1/2010 | DeMarco | 220/253 |
| 2010/0294772 | A1 * | 11/2010 | Judge | 220/288 |

* cited by examiner

*Primary Examiner* — Anthony Stashick
*Assistant Examiner* — Robert Stodola
(74) *Attorney, Agent, or Firm* — Salter & Michaelson

(57) ABSTRACT

A decorative cover object supported on the lid of a can to enable drinking from the can. The decorative cover object includes a decorative spout member having a drinking spout and an internal collar and an insert received by the internal collar and for support from the can. The insert includes a base that mates with the collar and a deflectable peripheral flange that releasably engages with the can lid.

16 Claims, 7 Drawing Sheets

DECORATIVE COVER OBJECT FOR A CAN

FIELD OF THE INVENTION

The present invention relates in general to a decorative cover object supported on the lid of a can, typically an aluminum can. More particularly, the present invention relates to a decorative cap, hat or helmet object supported on the lid of a can to enable drinking from the can.

BACKGROUND OF THE INVENTION

There are devices presently used that attach to the top of a typical aluminum can. For examples, refer to U.S. Design Pat. D567,659 to Gran et al. that describes a beverage container closure and dispensing device. Refer also to U.S. Pat. No. 4,852,776 to Patton that describes a drinking spout for a beverage can. However, there is no existing spout-type device that also simulates a sports entity.

Accordingly, it is an object of the present invention to provide a decorative spout member attached to the top lid of the can and in which a spout is formed for the purpose of drinking from the can once opened.

Another object of the present invention is to provide a decorative cover object that comprises a decorative spout member as well as an insert mounted on the can for enabling substitution of different decorative covers.

Still another object of the present invention is to provide a decorative cover object that is comprised of a decorative spout member including a drinking spout and an internal collar, and in which the decorative spout member further includes a cap or helmet structure having the drinking spout formed therein.

SUMMARY OF THE INVENTION

To accomplish the foregoing and other objects, features and advantages of the present invention there is provided a decorative cover object supported on the lid of a can to enable drinking from the can. The decorative cover object comprises a decorative spout member including a drinking spout and an internal collar; and an insert received by the internal collar and for support from the can. The insert includes a base that mates with the collar and a deflectable peripheral flange that releasably engages with the can lid.

Other aspects of the present invention include the insert base and internal collar have mating threaded surfaces; the collar and insert base both being cylindrical; including internal threads within the collar and external threads about the insert base adapted to threadedly engage with the internal threads within the collar to hold the insert in place relative to the collar; the insert is constructed of a plastic material with the insert base being more rigid than the insert peripheral flange; the decorative spout member also includes a cap or helmet structure having the drinking spout formed therein; the internal collar is supported integrally with an inner surface side of the cap or helmet structure; the insert peripheral flange has an angularly extending free end; including an engagement ring at the base of the peripheral flange; the base of the insert is defined by a cylindrical wall having external helical screw threads; the base of the insert also includes a support spoke that bridges across the cylindrical wall; and wherein the support spoke has multiple spokes and a center ring with each of the spokes extending between the ring and cylindrical wall.

Another embodiment is of a decorative cover object supported on the lid of a can to enable drinking from the can. The decorative cover object comprises a decorative spout member including a drinking spout and an internal collar; said decorative spout member further including a cap or helmet structure having the drinking spout formed therein; and said internal collar having a proximal end thereof formed integrally with an inner surface side of the cap or helmet and a distal end thereof formed as a deflectable peripheral flange that releasably engages with the can lid.

Other aspects of the present invention in this embodiment include the internal collar is cylindrical in shape; the deflectable peripheral flange has an angularly extending free end; including an engagement ring at the base of the peripheral flange; the proximal end of the collar is constructed of a rigid plastic material while the peripheral flange is constructed of a flexible non-rigid plastic material that is allowed to deflect to receive can lids of slightly different diameter; the internal collar is defined by a cylindrical wall that extends a greater distance than the length of the peripheral flange; the collar also includes a support spoke that bridges across the cylindrical wall; and wherein the support spoke has multiple spokes and a center ring with each of the spokes extending between the ring and cylindrical wall.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 8:
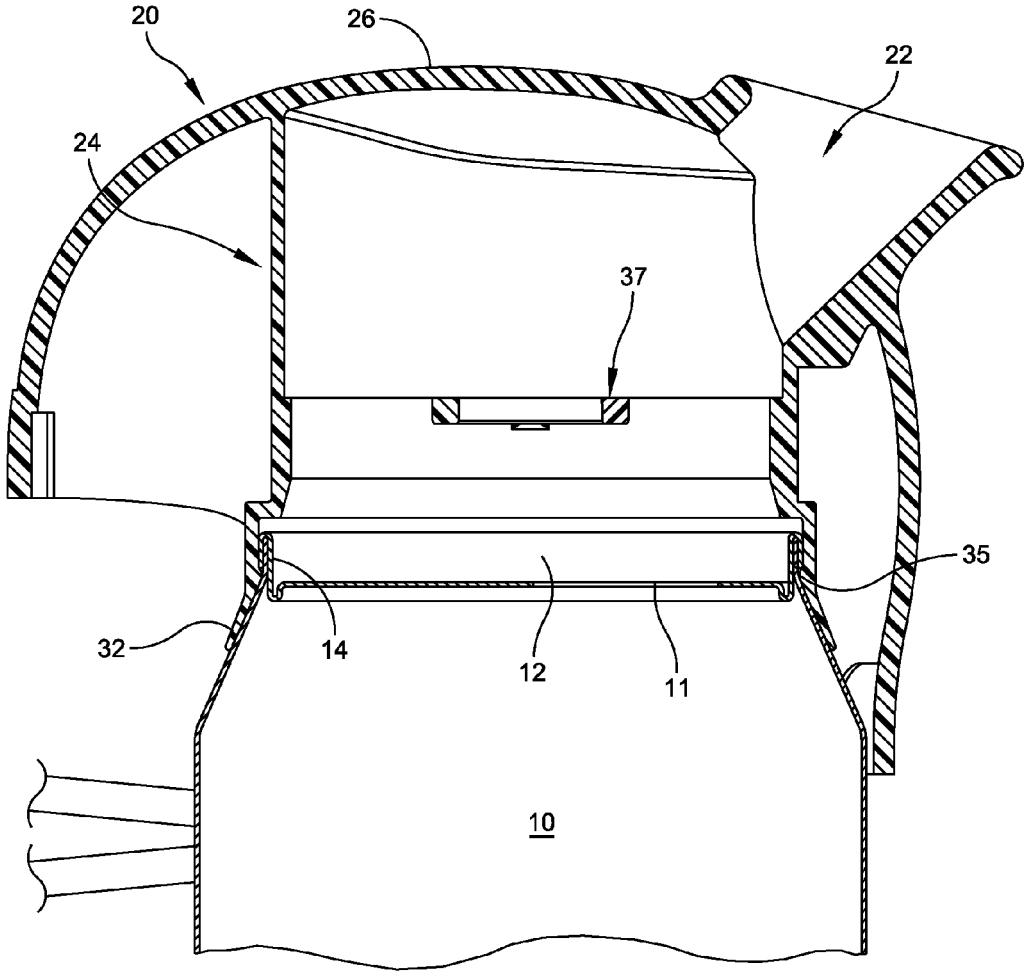
FIG. 8 is a cross-sectional view similar to that illustrated in FIG. 3 but for an alternate embodiment of the present invention.

Reference is now made to the drawings for an illustration of embodiments of the present invention. FIGS. 1-7 illustrate a first embodiment of the present invention incorporating, with the helmet or cap an insert. FIG. 8 is a cross-sectional view of an alternate embodiment of the present invention in which the insert is essentially integral with the support column.

Figure 1:
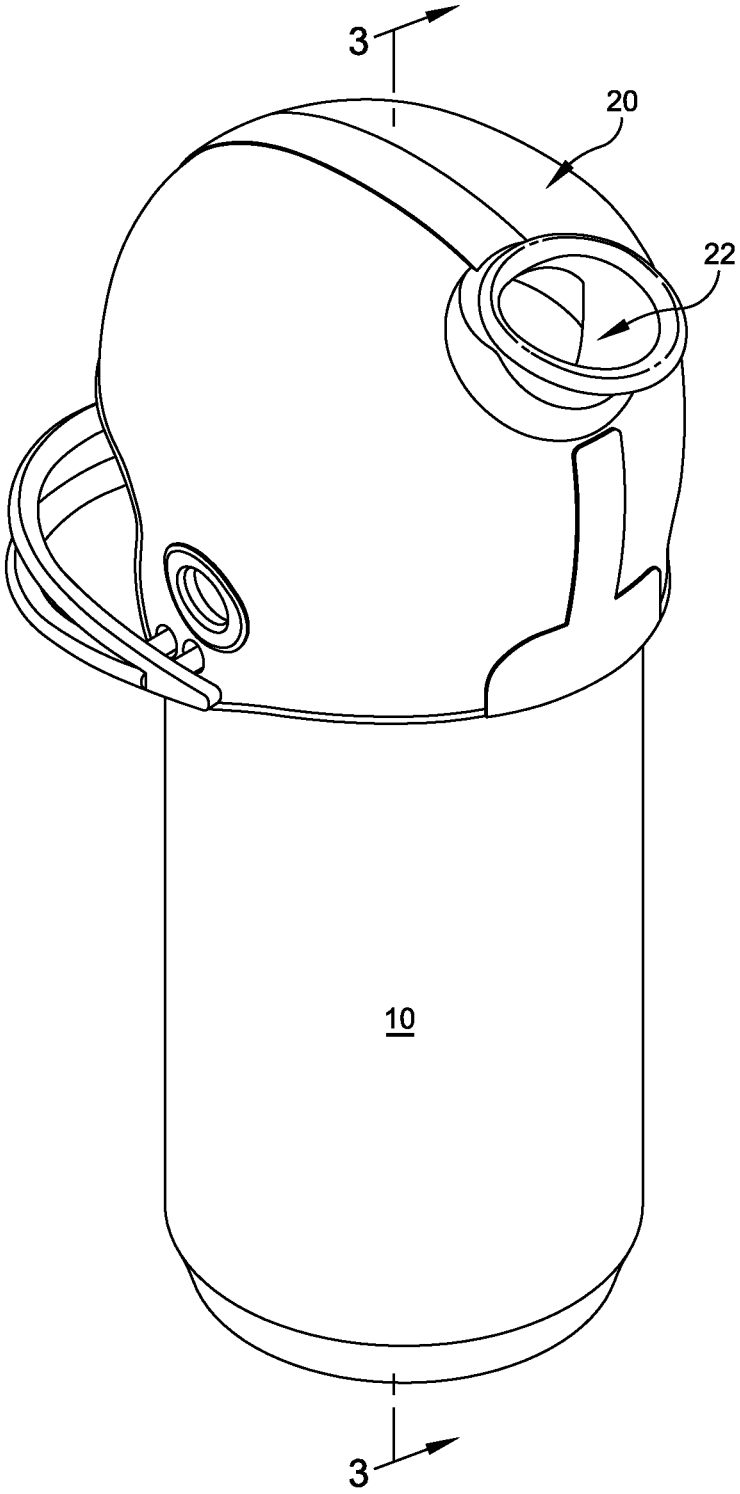
FIG. 1 is a perspective view of one embodiment of the decorative cover object of the present invention.
Figure 3:
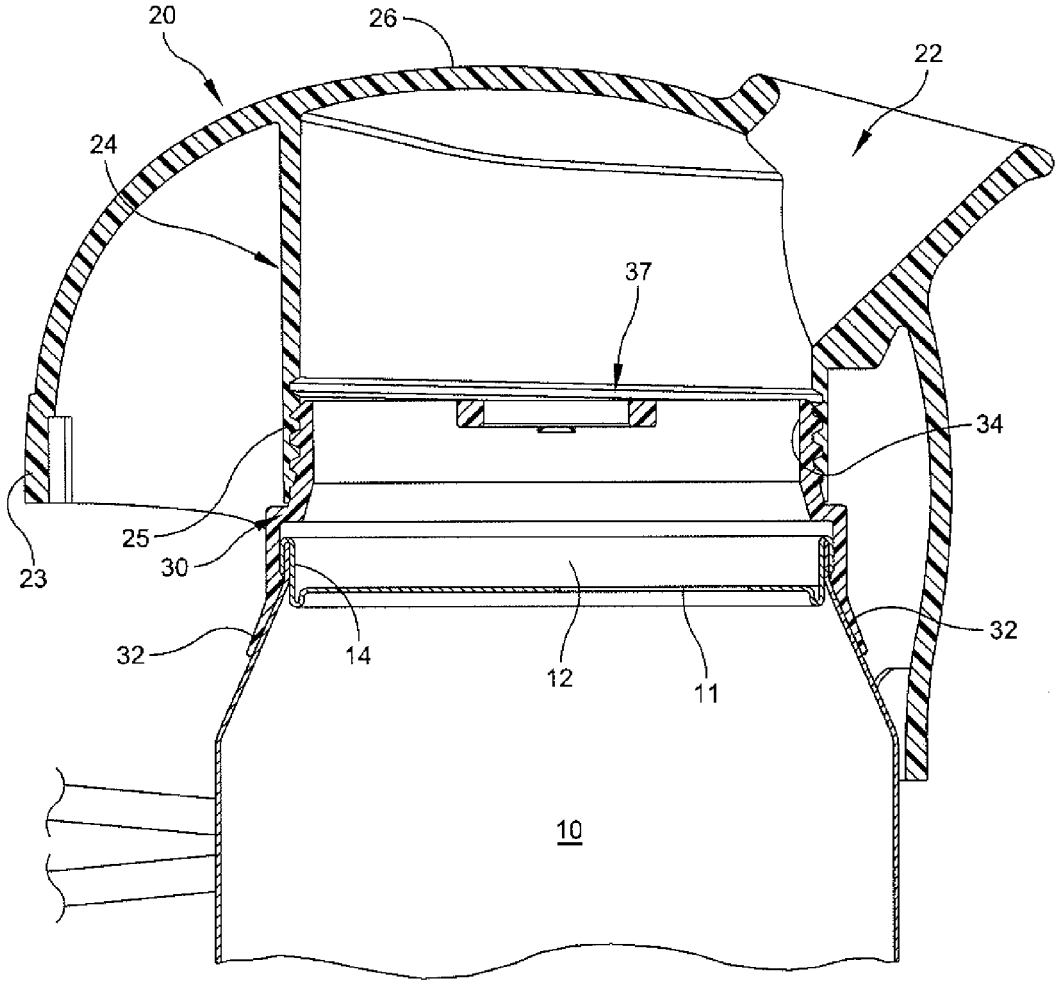
FIG. 3 is a cross-sectional view taken along line 3-3 of FIG. 1.

FIGS. 1 and 3 illustrate a typical aluminum can 10 which is considered of conventional design having a top lid 12 with a typical peripheral lip 14. As the aluminum can 10 is of conventional design it is not described in great detail herein. It is sufficient to indicate that the top of the can is provided with an opening 11 which is typically opened or closed by a flip-top member (not illustrated). Refer also to the enlarged fragmentary view of FIG. 6 that illustrates the can 10 with its peripheral lip 14 engaged with the insert.

The decorative cover of the present invention can assume many different forms. The one that is illustrated herein is a football helmet. Other covers or objects include, but are not limited to, a baseball cap, a cowboy hat, a Nascar helmet, a hockey helmet or goalie mask, a basketball, a soccer ball, a unique players, celebrity or politician's head, or any of the Disney character heads such as Mickey Mouse or Donald Duck. Regardless of the object used, at some area of the object there is provided a spout.

In the illustrated embodiment in FIGS. 1-7, there is provided a decorative spout member 20 in the form of a football helmet. This includes the illustrated drinking spout 22 and an internal cylindrical collar 24. The decorative spout member 20, as indicated previously, is formed as a cap or helmet structure having the drinking spout formed therein. In, for example, the cross-sectional view of FIG. 3, the helmet structure 26 is illustrated. The aforementioned internal collar 24 is integrally formed with the helmet structure 26 and in FIG. 3 is shown extending downwardly therefrom. It is also noted that the collar 24 is in fluid communication with the spout 22 as the drink in the can 10 is meant to pass through the collar 24 to the spout 22. The helmet structure 26, as well as the other components illustrated in the cross-sectional view of FIG. 3, are constructed of a rigid plastic material.

As indicated previously, the collar 24 is constructed of a plastic material and is substantially cylindrical in shape in fluid communication with the spout. The very bottom of the internal collar is internally threaded as indicated at 25 in FIGS. 2 and 3. The internal threads 25 of the collar are meant to releasably engage with external threads of the insert.

Figure 2:
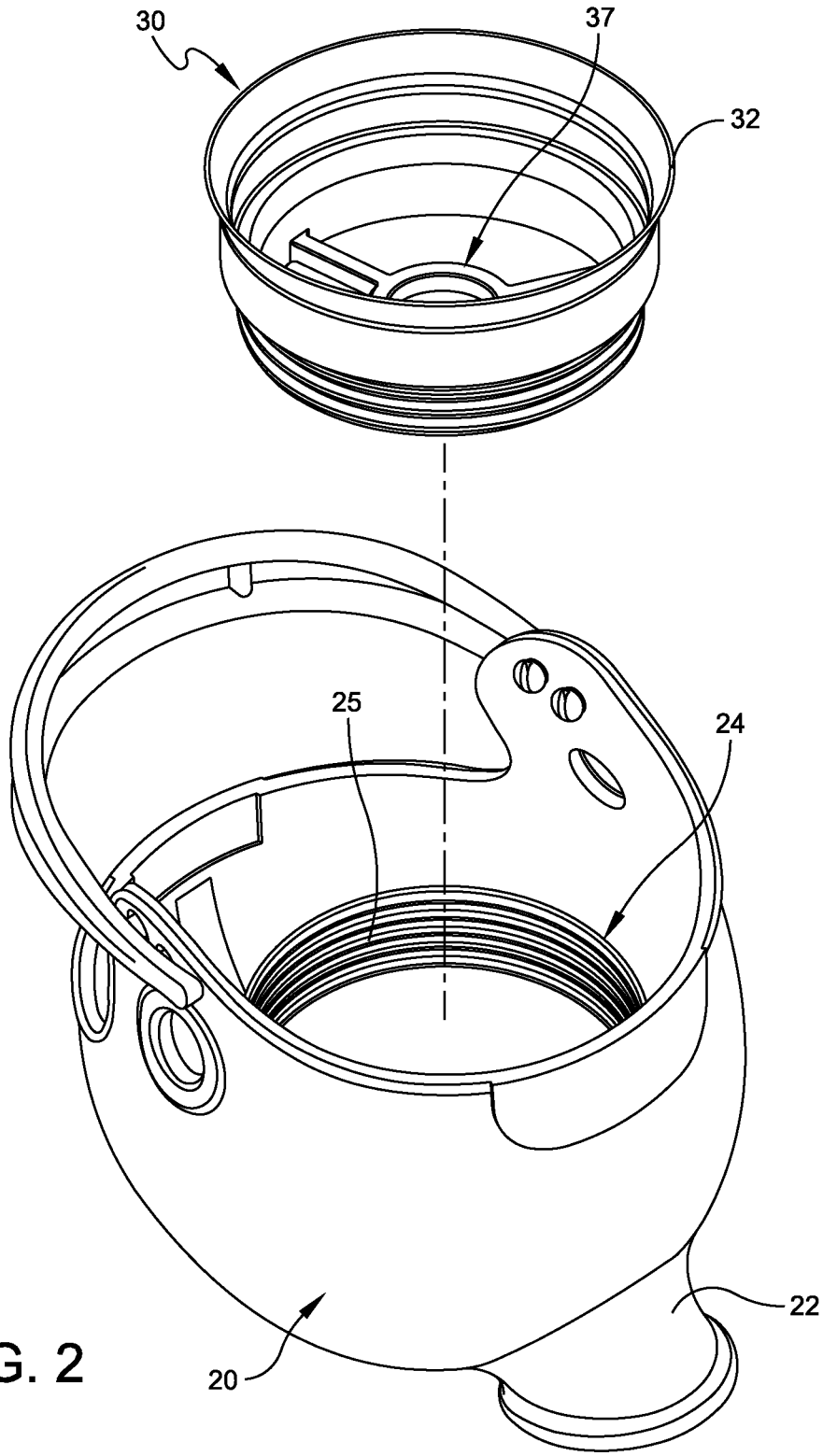
FIG. 2 is an exploded perspective view illustrating the spout member and insert.
Figure 4:
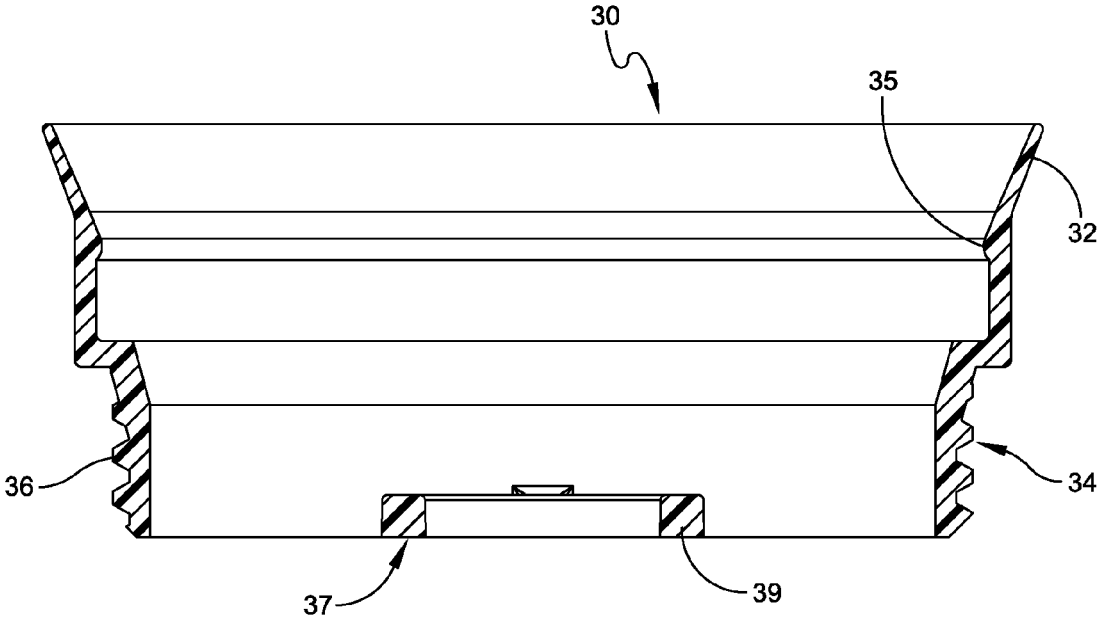
FIG. 4 is a cross-sectional view through the insert.
Figure 5:
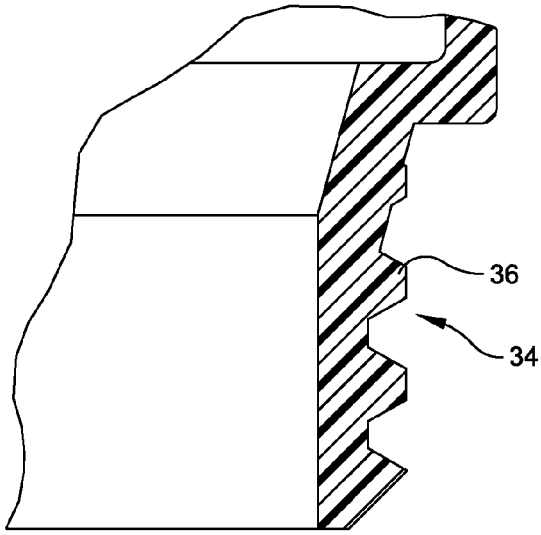
FIG. 5 is an enlarged fragmentary view of a portion of the insert.
Figure 6:
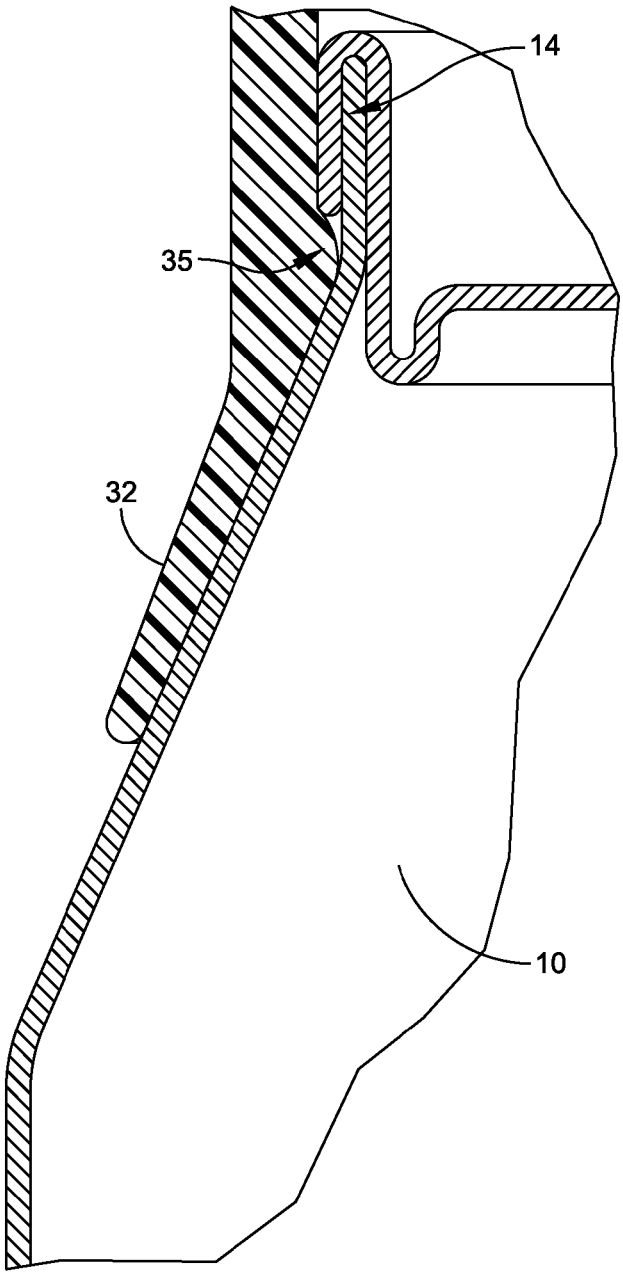
FIG. 6 is an enlarged fragmentary view at the flange of the insert member.
Figure 7:
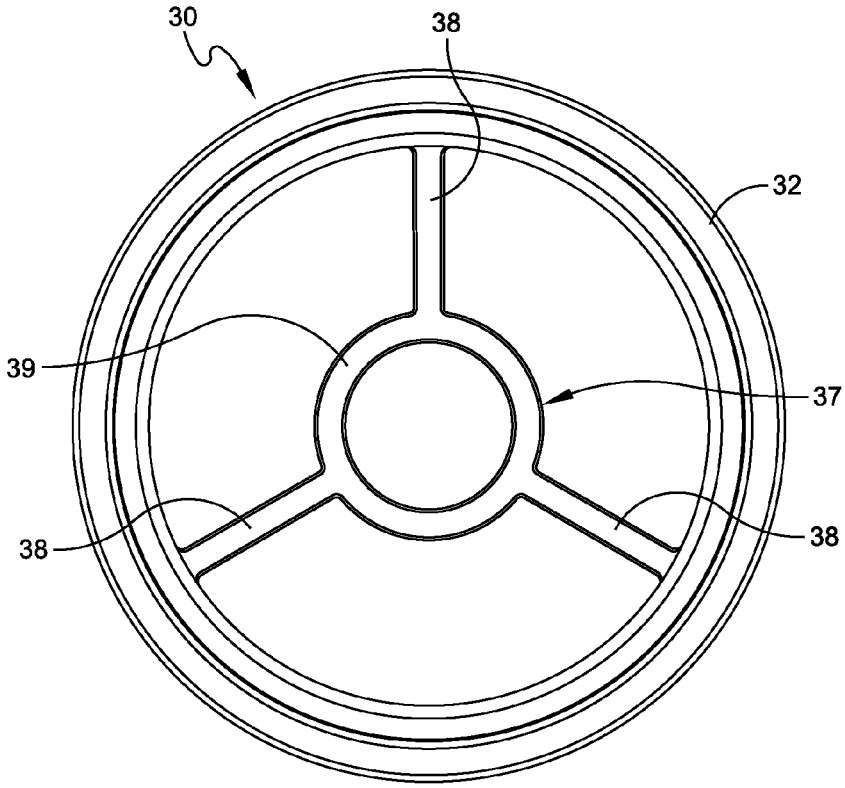
FIG. 7 is a plan view of the insert.

Reference is now made to FIGS. 2-4 for an illustration of further details of the insert 30. The insert 30 is also substantially of cylindrical construction and is made of a plastic material which is substantially rigid with the exception of the deflectable peripheral flange 32. Refer also to the enlarged fragmentary view of FIG. 6 illustrating the peripheral flange 32.

Thus, the insert 30 includes the deflectable peripheral flange 32, as well as a base 34. The base 34 is meant for mating with the collar. The deflectable peripheral flange releasably engages with the can lid as illustrated in FIG. 3. Although the majority of the insert is constructed of a hard plastic material, the flange is constructed of a softer plastic material so that it is readily flexible and deflectable. The deflectable peripheral flange 32, by virtue of its limited flexible construction, is able to accommodate can lips of different size and diameter. Moreover, an interlock is provided by means of an annular engagement ring 35. Refer in particular to the enlarged fragmentary cross-sectional view of FIG. 6 that shows the engagement ring 35 at the base of the peripheral flange 32. FIG. 6 also illustrates the interlock of the can lip 14 against the engagement ring 35. Because the flange 32 is capable of some limited deflection, cans of different diameter can readily be engaged with the flange and be also interlocked and held therewith primarily by means of the engagement ring 35. For providing mating between the insert and the spout member, the base 34 of the insert 30 is provided with external threads 36. Refer also to the cross-sectional view of FIG. 3 that illustrates the threads 36 engaging with threads 25 of the internal collar 24. This mating threaded engagement may be provided by a conventional helical threading pattern.

Thus, the insert is also defined by a substantially cylindrical wall with the threads 36 disposed on the outside of that wall. The base 34 of the insert also includes a support spoke structure 37. Refer in particular to the plan view of FIG. 7 that shows the support spoke structure. The support spoke structure bridges across the cylindrical wall 34. The support spokes are preferably arranged in a radial pattern as illustrated having multiple spokes 38 and a center ring 39. Each of the spokes extends between the center ring 39 and the cylindrical wall of the base of the insert.

Reference is now made to FIG. 8 which is a cross-sectional view similar to that previously described in connection with FIG. 3 but essentially having the insert integrally formed with the collar 24. Thus, rather than having interengaging threads, the internal collar 24 is provided itself with the peripheral flange 32. FIG. 8 illustrates the interengagement of the can lip with the flange 32 and associated engagement ring 35. Thus, in the embodiment of FIG. 8 as far as the construction of the flange is concerned, it is substantially the same as illustrated in the enlarged fragmentary view of FIG. 6.

In some ways the first embodiment of the present invention illustrated in FIGS. 1-7 provides a greater flexibility in that different sport covers can be engaged with the same insert. Thus, from a selling viewpoint, the insert may be provided with a series of different helmets or caps that are interchangeable with the insert.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A decorative cover object supported on a top lid of a can to enable drinking of a liquid from the can, said decorative cover object comprising:

a decorative spout member including a drinking spout having a center axis and through which the liquid in the can directly passes, and an internal collar;

said decorative spout member further including a cap or helmet structure having proximal and distal sides and having the drinking spout and internal collar integrally formed therewith;

a portion of the internal collar extending upwardly to form an inner cylindrical wall collar member having a center axis and that is integrally formed with an inner surface of the cap or helmet structure;

said drinking spout constructed and arranged to have its center axis disposed at an acute angle to the center axis of the cylindrical wall collar member so as to dispose the drinking spout at the proximal side of the cap or helmet structure;

said inner cylindrical wall collar member having a height that is greater toward the distal side of the cap or helmet structure in comparison to a height that is lesser toward the proximal side of the cap or helmet structure so as to provide a fluid passage chamber between the drinking spout and the container;

the distal side of the cap or helmet structure being defined by a peripheral edge that is disposed distal of the inner cylindrical wall collar member;

an insert received by said internal collar and for support with a peripheral lip at the top lid of the can;

the insert including a base that mates with the collar and a deflectable peripheral flange member that releasably engages with the peripheral lip of the can;

the inner cylindrical wall collar member being internally threaded at a bottom end thereof;

the insert base formed as a cylindrical wall that is externally threaded and that is integrally formed with the deflectable peripheral flange member;

the externally threaded cylindrical wall of the insert base for threadingly mating with the internally threaded inner cylindrical wall collar member;

the deflectable peripheral flange member including a cylindrical wall member and an integrally formed outwardly tapered peripheral flange;

the insert base cylindrical all having proximal and distal sides with the deflectable peripheral flange member integrally supported at the distal side thereof;

a support spoke structure that bridges across the base cylindrical wall of the insert and that is attached at the proximal end of the base cylindrical wall and opposite to the attachment of the deflectable peripheral flange;

said support spoke structure including multiple radially extending spokes and a center ring with each of the spokes extending radially between the center ring and the base cylindrical wall;

and an inwardly extending annular engagement ring disposed about the deflectable peripheral flange member and disposed between the cylindrical wall member of the deflectable peripheral flange member and the deflectable peripheral flange;

the inwardly extending annular engagement ring formed with a convexity so that the wall thickness thereat is greater than the wall thickness about the convexity;

the inwardly extending annular engagement ring interlocking the peripheral lip of the can with the deflectable peripheral flange member.

2. The object of claim 1 wherein the inner diameter of the externally threaded cylindrical wall of the insert base is less than the inner diameter of the cylindrical wall member of the deflectable peripheral flange member.

3. The object of claim 2 including a step between the externally threaded cylindrical wall of the insert base and the cylindrical wall member of the deflectable peripheral flange member.

4. The object of claim 2 wherein the insert is constructed of a plastic material with the insert base being more rigid than the insert peripheral flange.

5. The object of claim 3 wherein the threading between the insert and cap or helmet structure enables the insert to be selectively interchangeable with different cap or helmet structures.

6. The object of claim 5 wherein the step is a right angle step, the inwardly extending annular engagement ring is disposed between a bottom end of the cylindrical wall member of the deflectable peripheral flange member and the deflectable peripheral flange itself, and, when the top of the can engages with the insert, the top lid of the can engages the step.

7. The object of claim 1 wherein the insert peripheral flange has an angularly extending free end.

8. The object of claim 1 wherein the inner cylindrical wall collar member includes an upper un-threaded section, and the peripheral edge terminates below the upper un-threaded section.

9. The object of claim 8 wherein the peripheral edge is disposed in an arcuate path in a single plane.

10. The object of claim 9 including a step between the externally threaded cylindrical wall of the insert base and the cylindrical wall member of the delectable peripheral flange member, and wherein the peripheral edge terminates at the same height as the step.

11. A decorative cover object supported on a top lid of a can to enable drinking of a liquid from the can, said decorative cover object comprising:

a decorative spout member including a drinking spout having a center axis and through which the liquid in the can directly passes, and an internal collar;

said decorative spout member further including a cap or helmet structure having proximal and distal sides and having the drinking spout and internal collar integrally formed therewith;

a portion of the internal collar extending upwardly to form an inner cylindrical wall collar member having a center axis and that is integrally formed with an inner surface of the cap or helmet structure;

said drinking spout constructed and arranged to have its center axis disposed at an acute angle to the center axis of the cylindrical wall collar member so as to dispose the drinking spout at the proximal side of the cap or helmet structure;

said inner cylindrical wall collar member having a height that is greater toward the distal side of the cap or helmet structure in comparison to a height that is lesser toward the proximal side of the cap or helmet structure so as to provide a fluid passage chamber between the drinking spout and the container;

the distal side of the cap or helmet structure being defined by a peripheral edge that is disposed distal of the inner cylindrical wall collar member;

an insert received by said internal collar and for support with a peripheral lip at the top lid of the can;

the insert including a base that mates with the collar and a deflectable peripheral flange member that releasably engages with the peripheral lip of the can;

the inner cylindrical wall collar member being internally threaded at a bottom end thereof;

the insert base formed as a cylindrical wall that is externally threaded and that is integrally formed with the deflectable peripheral flange member;

the externally threaded cylindrical wall of the insert base for threadingly mating with the internally threaded inner cylindrical wall collar member;

the deflectable peripheral flange member including a cylindrical all member and an integrally formed outwardly tapered peripheral flange;

the insert base cylindrical wall having proximal and distal sides with the deflectable peripheral flange member integrally supported at the distal side thereof;

wherein the inner cylindrical wall collar member includes an upper un-threaded section, and the peripheral edge terminates below the upper un-threaded section.

12. The object of claim 11 including a support spoke structure that bridges across the base cylindrical wall of the insert and that is attached at the proximal end of the base cylindrical wall and opposite to the attachment of the deflectable peripheral flange; said support spoke structure including multiple radially extending spokes and a center ring with each of the spokes extending radially between the center ring and the base cylindrical wall.

13. The object of claim 12 including an inwardly extending annular engagement ring disposed about the deflectable peripheral flange member and disposed between the cylindrical wall member of the delectable peripheral flange member and the deflectable peripheral flange; the inwardly extending annular engagement ring formed with a convexity so that the wall thickness thereat is greater than the wall thickness about the convexity.

14. The object of claim 13 wherein the inwardly extending annular engagement ring interlocking the peripheral lip of the can with the deflectable peripheral flange member.

15. The object of claim 11 wherein the peripheral edge is disposed in an arcuate path in a single plane.

16. The object of claim 15 including a step between the externally threaded cylindrical wall of the insert base and the cylindrical wall member of the deflectable peripheral flange member, and wherein the peripheral edge terminates at the same height as the step.

* * * * *